US005743679A

United States Patent [19]

Gottschlich

[11] Patent Number: 5,743,679

[45] Date of Patent: Apr. 28, 1998

[54] HYDRAULIC SHIELD SUPPORT FRAME

[75] Inventor: Georg Gottschlich, Wuppertal, Germany

[73] Assignee: DBT Deutsche Bergbau-Technik GmbH, Wuppertal, Germany

[21] Appl. No.: 691,312

[22] Filed: Aug. 2, 1996

[30] Foreign Application Priority Data

Aug. 2, 1995 [DE] Germany ..... 195 28 378.3

[51] Int. Cl.[6] ..... E21D 15/44; E21D 23/00

[52] U.S. Cl. ..... 405/296; 405/293

[58] Field of Search ..... 405/291–299; 299/31, 33

[56] References Cited

U.S. PATENT DOCUMENTS

| | | | |
|---|---|---|---|
| 3,347,050 | 10/1967 | Dommann et al. | 405/297 |
| 3,383,867 | 5/1968 | Ormerod | 405/297 X |
| 3,392,533 | 7/1968 | Bell | 405/293 |
| 3,483,705 | 12/1969 | Roberts | 405/296 |
| 3,512,364 | 5/1970 | Holland | 405/293 |
| 3,811,288 | 5/1974 | Wehner et al. | 405/297 X |
| 4,815,898 | 3/1989 | Wojaczek et al. | 405/296 |

FOREIGN PATENT DOCUMENTS

| | | | |
|---|---|---|---|
| 3813195 | 11/1989 | Germany . | |
| 284968 | 1/1965 | Netherlands | 405/294 |
| 830704 | 3/1960 | United Kingdom | 405/293 |
| 1160513 | 8/1969 | United Kingdom . | |

*Primary Examiner*—Dennis L. Taylor
*Attorney, Agent, or Firm*—Cushman Darby & Cushman, IP Group of Pillsbury Madison & Sutro LLP

[57] ABSTRACT

A shield support frame is constructed from main shoes (5) on the ground, hydraulic props (6) and a main canopy (7) borne by them and a gob shield (8) borne on guide links (10). On the face side, there is a front cantilever (24) linked so as to be adjustable in height from the main canopy (7), on which a sliding canopy (25) is guided so as to be able to slide in the direction of the face. On the ground, an adjustable baseplate (21) is arranged at a distance in front of the main shoes (5) and connected via a horizontal joint axle (22) to the extending part of the shifting gear (3). Front assembly props (23) mounted on the adjustable baseplate (21) support the sliding canopy (25). The tip of the plate of the adjustable baseplate (21) is lifted from the ground during forward movement.

9 Claims, 2 Drawing Sheets

HYDRAULIC SHIELD SUPPORT FRAME

The present invention relates a hydraulic shield support frame for long wall mining with a roof canopy supported by height-adjustable props and an attached cantilevered sliding canopy, which can be extended in the direction of the face, adjusted in height, and is supported by at least one front prop, whereby a transversely mounted gob shield is linked to the goaf end of the main canopy and is adjusted in height via a four link lemniscate mechanism on main shoes of the base, on which a hydraulically adjustable advancing cylinder is mounted.

Definitive targets for the further development of hydraulic shield supports are given in the DE-Zeitschrift Glücklauf 119 (1983), p. 925 ff: The support of the roof up to the face, the working together of the winning equipment and the support as well as the minimisation of the weight of the support. Roof spoil on the face of the coal face, which arises from late installation of supports after winning, from insufficient supporting power and repeated load releases on the roof on advancing of the support, cause impaired production. Cantilever bars, particularly when attached to the main canopy of the shield support frame, sliding canopies, extensible in the direction of the face, should reduce the distance of the tip of the canopy from the face and avoid delays in support.

A two part shield support is proposed, with a main canopy and a sliding canopy on the roof and with a baseplate on the face side which can be extended by a sliding plate on the ground, which is connected via the links of a lemniscate mechanism and a transversely mounted gob shield with the main canopy, whereby a prop positioned on the shoe supports the main canopy and another prop positioned on the sliding plate supports the sliding canopy. Between the sliding canopy which penetrates deeply into the main canopy, and between the sliding plate introduced just as deeply into the base shoe, an upper and a lower advancing cylinder are engaged in each case. In this way the face side support front part, made up of sliding baseplate, sliding canopy and front prop(s) can be moved to the front with respect to the goaf side back support element using the advancing cylinders, whereby advancing "under load" with props powered should be effected, i.e. with sliding canopies and shoes on the roof and base.

This construction is not suitable for faces with changing usable seam thicknesses or for soft and step-formed ground bases, due to the extremely long shoes and equally long articulated roof members. The advancing process turns out to be very laborious due to the high friction forces which must be overcome at the roof and the floor during movement under load. Added to this, the advantage of the cantilevered support is lost again, if the advanced front prop has to be at least partly slackened in its support to move the goaf side part of the equipment, so as to make it possible to slide the main canopy up to the sliding canopy and the shoes to the sliding shoes.

Movement of the shield support frame is frequently hindered by soft and stepped floor formations, which the tips of the shoes run up against. Various lifting arrangements for the shoes are proposed to overcome this. It is for instance known from DE-A-38 35 525 that a lifting plate is provided under the shoe, pivoted in a swivel bearing, with one end adjustable. A cylinder supported on the shoe in a vertical position can bring the lifting plate into an inclined position, so that the shoe overall is raised a little in its forward region from the floor. This somewhat expensive arrangement is however not especially effective, because the lifting plate positioned at the tip of the shoe itself penetrates into the floor in soft ground.

In DE-A-38 13 195 a lifting arrangement is proposed for underground mining operations, in which the shock support of a shield support frame positioned at the face and the plough guide on the face side form a moving unit with the face conveyor. Shield support frames conventionally assembled from props, main canopy, gob shield, lemniscate mechanism, main shoes and moving gear are arranged on the goaf side from the conveyor along the face and connected to it via the advancing cylinders. From the main canopy there is in each case a front cantilevered sliding canopy on the face side, whose extensible sliding canopy is supported by the associated shock support which is arranged on the face side of the conveyor between it and the plough guide. The application possibilities of a construction with this arrangement of props are however restricted to plough face operations, since the control of a mining machine on the conveyor in cutting operations requires a prop-free stope face. During winning the shock supports have to be relaxed to move the conveyor, so that the roof remains unsupported over a wide area during that critical phase, without the cantilevered support of the support canopy.

Proceeding from the state of the technology stated above it is the aim of the present invention to provide a shield support frame which facilitates an early durable support of the exposed roof close to the face with high supporting power.

Accordingly, the present invention is directed to a hydraulic shield support frame as described in the opening paragraph of the present specification in which the front assembly prop is positioned on an adjustable baseplate on the goaf side of a conveyor positioned at the face, which adjustable baseplate is connected to the advancing cylinder via a horizontal joint axle and is movable with respect to the main shoes, whereby the adjustable baseplate can be lifted at its tip during advancing of the front assembly prop using tensionable swivelling cylinders positioned at a distance above the joint axle.

Advantageously, the advancing cylinder engages with an intermediate plate arranged on the base, which is linked to the joint axle of the adjustable baseplate by a joint head and which forms the bearing for the swivel cylinders engaging with the adjustable baseplate.

Preferably, the advancing cylinder is housed between two main shoes with an advancing mechanism, which is supported centrally on a cross yoke joining the two main shoes together on the goaf side and that parallel to the advancing cylinder on the advancing mechanism, movable guide bars are attached to the intermediate plate.

In a preferred embodiment, the swivel cylinders are set to pull in during the advancing of the adjustable baseplate.

Advantageously, two front assembly props are installed alongside each other on the adjustable baseplate.

The present invention follows an old miner's rule, under which an exposed hollow must immediately be secured with a prop. A prop on the face side in front of the main shoe, positioned on a adjustable baseplate and a telescopic cantilevered canopy articulated on the main canopy form a cantilevered support which can be advanced independently and positioned in the free area so as to support the exposed roof immediately over a large surface with high supporting power. Whilst advancing, the cantilever is supported and controlled by the components of the shield support frame arranged on the goaf side, which are necessary for the functions of shielding (roof canopy and gob shield) and transposition (advancing mechanism).

There are two mutually connected components arranged one after the other in the direction of movement and connected via the advancing and ram cylinders, which independently of each other support the roof with their own support props and move forward at intervals from each other with mutual support. The duration of time for movement of a cantilever, comprising only a few components, is short. It follows that the cantilevers of shield support frames standing in a row alongside each other can advance in quick succession and support the exposed roof, even at high winning machine marching speeds, immediately following their progress. Since the goaf side shield construction can follow after an interval, the progress of mining no longer depends on the speed of movement of the support. The arrangement of the props in the shield frame results in an even and thus favourable distribution of the support power exerted by the props on the roof surface to be supported as a precondition for the reduction of the weight of the support.

The adjustable baseplate linked to the extending advancing cylinder on the face side can swivel in height with the aid of a swivelling cylinder which operates above the joint axis. To move the cantilever assembly forwards, the swivelling cylinder is, after the load is taken off the front assembly prop, actuated at the same time as the extending advancing cylinder, so that the adjustable baseplate swivels on the swivel axle and lifts its tip from the ground. The cantilever assembly is then moved forward with the face end of the adjustable baseplate directed upwards, which in advancing onto loose heaps and uneven places (steps) glides up on the ground. The small weight of the components of the cantilever assembly in comparison with the goaf side shield assembly sets only a small resistance to the upwards slide of the adjustable baseplate, which does not delay the advancing process. The cantilever assemblies are moved in train one after the other and support the exposed roof immediately after the winning using the entire supporting power of the front props. The substantially slower process of moving the goaf side shield assembly then follows and can if required be performed simultaneously at several parts of the longwall, without detracting from the winning work at the face. This results in a substantial advantage of the invention, that break-up of the roof stone is avoided because the roof surface, supported by the cantilever assemblies is not again relaxed during the following movement of the shield assemblies, but remains supported at full power.

An example of a hydraulic shield support frame made in accordance with the present invention is described below with reference to the attached drawings, in which.

Figure 1:
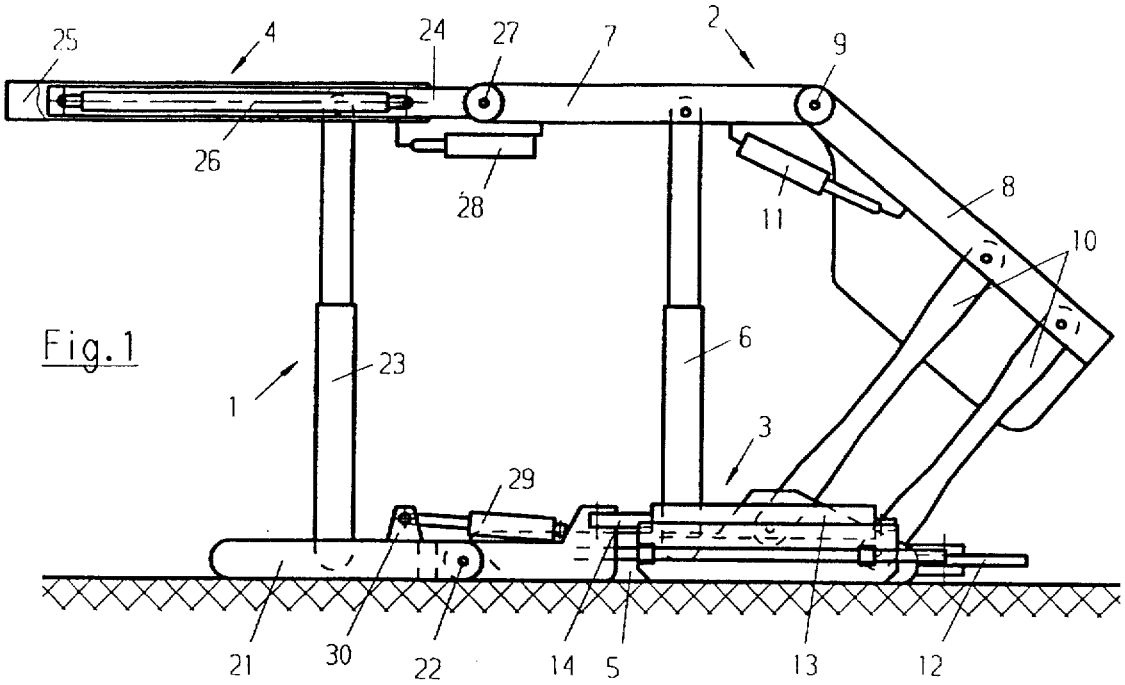
FIG. 1 is a side view of a shield support frame according to the present invention in the basic position before advancing showing the advancing mechanism.

A hydraulic stepping powered support assembly is made up of two components which can be moved relative to each other, a cantilever assembly 1 and a shield element 2, which are connected together by an advancing mechanism 3 on the ground side and a cantilevered extensible sliding canopy 4 on the roof side.

The shield element 2 comprises, as in conventional construction, of two main shoes 5 arranged on the ground parallel to each other in the direction of movement, on each of which a hydraulically height-adjustable prop 6 is arranged to support a main canopy 7. A gob shield 8, inclined to the goaf side is linked to the goaf side end of the main canopy 7 by a horizontal connecting link 9 and with each of the main shoes 5 by two essentially parallel links 10, which can swivel in height, arranged one behind the other in a four link lemniscate mechanism. The connecting linkage 9 is stabilised by an angle cylinder 11 fixed between the main canopy 7 and the gob shield 8.

The advancing mechanism 3 is arranged in the middle between the two main shoes 5 and on the shield element 2 is supported on a cross yoke 12 which links the shoes 5 together on the goaf side. An advancing cylinder 13 of the advancing mechanism 3 is provided with a piston rod 14 which extends in the direction of the face (to the left in the drawings) and is positioned in a control frame 15, which is fixed on the goaf side by a vertical joint axle 16 to the cross yoke 12. The piston rod 14 and two sliding guide bars 17 positioned on either side of the control frame 15 are fastened on the face side to an intermediate plate 18 arranged on the base. The intermediate plate 18 engages on the face side by means of a joint head 19 with a pivot 20 of a adjustable baseplate 21. The link between the adjustable baseplate 21 and the intermediate plate 18 is effected by means of the joint axle 22 horizontally passing through the joint head 19 and the pivot 20.

The adjustable baseplate 21 is a part of the cantilever assembly 1, which includes also at least one, two in the example of construction, hydraulically height-adjustable props 23 positioned on the adjustable baseplate 21 as well as the working sliding canopy extendable in the direction of the face. This is assembled from an inner working canopy 24 and a carrying frame shaped sliding canopy 25, which can be moved in a sliding manner guided on its profile, which can be extended with the help of a ram cylinder 26 supported on the working canopy 24 in the direction of the face. The working canopy 24 can be swivelled vertically on a horizontal joint axle 27 to which it is jointed on the face side end of the main canopy 7, whereby the joint axle 27 is stabilised by an adjusting cylinder 28 which engages with the main canopy 7 as well as the working canopy 24. The front assembly supports 23 support the sliding canopy 25 in canopy bearings, not shown, on the underside of the sliding canopy 25.

The adjustable baseplate 21 can, in the unloaded state of the front assembly supports 23, be tilted around the joint axle 22 in the pivot 20 with the aid of two swivelling cylinders 29 arranged parallel to each other. The swivelling cylinders 29 are supported at a vertical distance from the joint axle 22 at one end on the intermediate plate 18 and at the other end in housings 30 on the adjustable baseplate 21.

Figure 2:
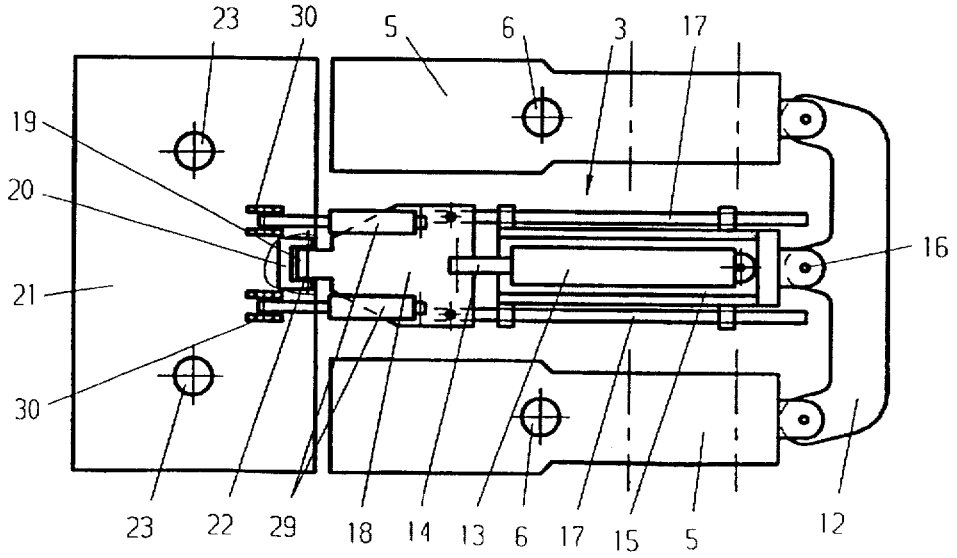
FIG. 2 is a plan view of the ground side components of the shield support frame shown in FIG. 1.
Figure 3:
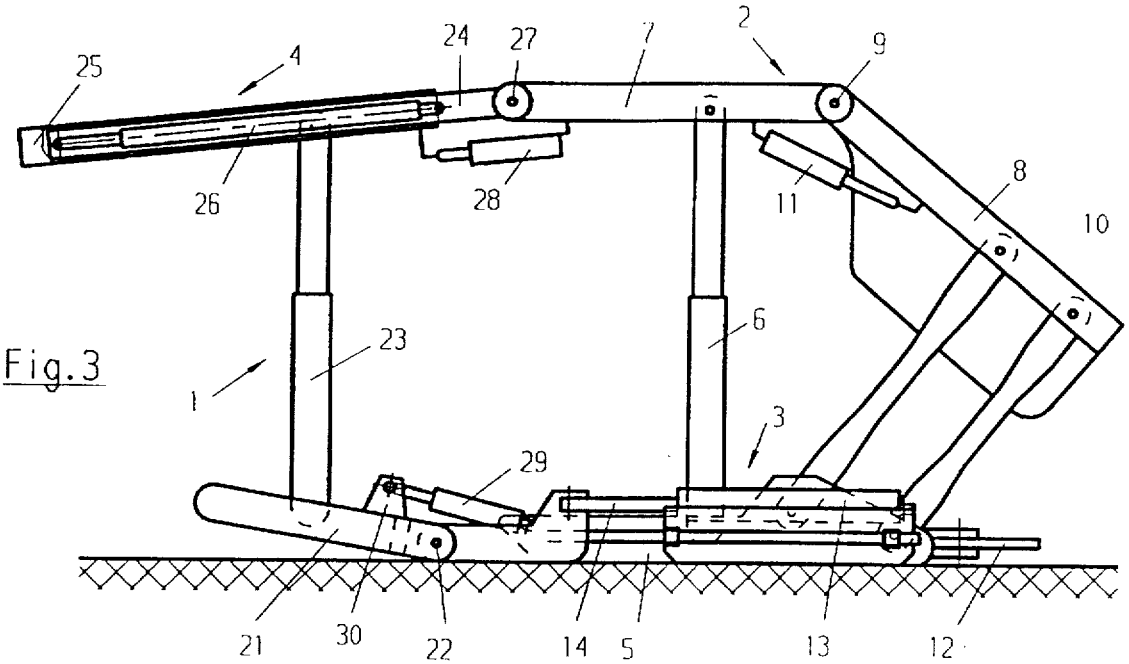
FIG. 3 is a side view of the shield support frame during advancing of the face side cantilever construction.
Figure 4:
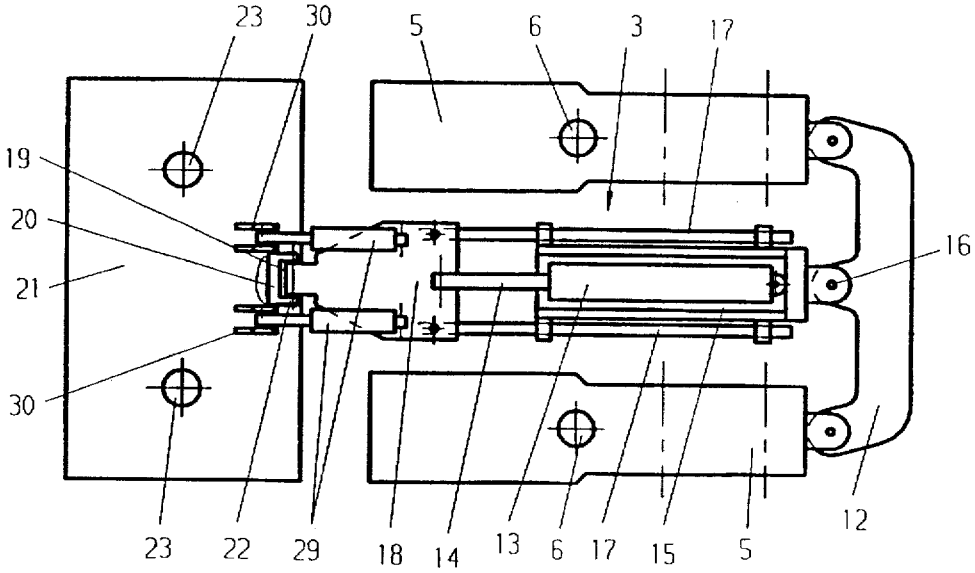
FIG. 4 is a plan view of the ground side components of the shield support frame shown in FIG. 3.

The shield support frames according to the present invention, which are arranged alongside each other along the front of the face, are individually one after the other immediately moved into contact with the extraction area and, similarly, immediately after the passing of the extraction machine, using the cantilever assemblies 1, by a step in the direction of the face, which is determined by the stroke of the advancing cylinder 13. In the basic version of the construction according to FIGS. 1 and 2 the main sliding shoes 5 are drawn up close to the adjustable baseplate 21 with the advancing cylinder 13 retracted and the sliding canopy 25 retracted. The conveyer located at the face in front of the shield support frame and the extraction machine which can traverse on it are not shown in the drawing.

The move forwards into the exposed area at the face occurs immediately after the extraction. The cantilevered canopy 4 is released from the roof, by relaxing the front assembly support 23 and slightly retracting it. The advancing cylinder 13 and the ram cylinder 26 are synchronously extended with the aid of a parallel control. At the same time the swivelling cylinders 29 supported on the intermediate plate 18 are activated and drawn in. This causes the adjustable baseplate 21 to tilt around the swivel axle 22 and lift the tip of the plate upwards. The adjustable baseplate 21 remains during the whole advancing process of the cantilever element 1 in a raised oblique position, so that it can slide over uneven places and over dispersed debris on the floor. With the extending ram cylinder 26 the released sliding canopy 25 will travel out, sliding on the working canopy. The cantilever element 1 is supported during the advancing process on the fixed shield element 2 and is guided by this in the advancing direction mainly via the cantilevered canopy 4 which is linked to the main canopy 5, whereby additionally at floor level guidance can be effected by leading bars or similar, not shown.

The shield elements 2 are moved to meet the cantilever element 1, which forms the abutment for the again retracting advancing cylinder 13 and the ram cylinder 26. During the retraction the working canopy 24 pushes itself back into the sliding canopy 25 which is braced on the roof. The sliding canopy 25, guided on the fixed working canopy 24 offers itself via the joint axle 27 also as an abutment for the lifting of the face side of the main shoes 5, insofar as the props 6 are suitably retracted. There is no danger of roof deterioration during the movement of the shield element 2, because the cantilevered roof area is not released from load again.

Fundamentally it is possible that components shown singly, such as props, for example, will be applied in pairs to improve stability.

I claim:

1. A hydraulic shield support frame for long wall mining with a roof canopy supported by height-adjustable props and an attached cantilevered sliding canopy, which can be extended in the direction of the face, adjusted in height, and is supported by at least one front prop, whereby a transversely mounted gob shield is linked to the goaf end of the main canopy and is adjusted in height via a four link lemniscate mechanism on main shoes of the base, on which a hydraulically adjustable advancing cylinder is mounted thereby, in which the front assembly prop is positioned on an adjustable baseplate on the goaf side of a conveyor positioned at the face, which adjustable baseplate is connected to the advancing cylinder via a horizontal joint axle and is movable with respect to the main shoes, whereby the adjustable baseplate can be lifted at its tip during advancing of the front assembly prop using tensionable swivelling cylinders positioned at a distance above the joint axle.

2. A shield support frame according to claim 1, in which the advancing cylinder engages with an intermediate plate arranged on the base, which is linked to the joint axle of the adjustable baseplate by a joint head and which forms the bearing for the swivel cylinders engaging with the adjustable baseplate.

3. A shield support frame according to claim 2, in which the advancing cylinder is housed between two main shoes with an advancing mechanism, which is supported centrally on a cross yoke joining the two main shoes together on the goaf side and that parallel to the advancing cylinder on the advancing mechanism, movable guide bars are attached to the intermediate plate.

4. A shield support frame according to claim 1, in which the swivel cylinders are set to pull in during the advancing of the adjustable baseplate.

5. A shield support frame according to claim 1, in which two front assembly props are installed alongside each other on the adjustable baseplate.

6. A shield support frame according to claim 2, in which the swivel cylinders are set to pull in during the advancing of the adjustable baseplate.

7. A shield support frame according to claim 2, in which two front assembly props are installed alongside each other on the adjustable baseplate.

8. A shield support frame according to claim 3, in which the swivel cylinders are set to pull in during the advancing of the adjustable baseplate.

9. A shield support frame according to claim 3, in which two front assembly props are installed alongside each other on the adjustable baseplate.

* * * * *